US006266495B1

(12) United States Patent
Yuminamochi et al.

(10) Patent No.: US 6,266,495 B1
(45) Date of Patent: Jul. 24, 2001

(54) IMAGE FORMING APPARATUS USING TRANSFER ROLLER HAVING LOW RESISTANCE UNEVENNESS IN CIRCUMFERENTIAL DIRECTION

(75) Inventors: Takayasu Yuminamochi, Shizuoka-ken; Masaru Shimura, Numazu, both of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/267,704

(22) Filed: Mar. 15, 1999

(30) Foreign Application Priority Data

Mar. 13, 1998 (JP) ..... 10-082634

(51) Int. Cl.[7] ..... G03G 15/00; G03G 15/16
(52) U.S. Cl. ..... 399/66; 399/43; 399/314
(58) Field of Search ..... 399/66, 313, 314, 399/297, 168, 43; 430/126

(56) References Cited

U.S. PATENT DOCUMENTS 5,179,397 * 1/1993 Ohzeki et al. ..... 399/297 X
5,235,386 8/1993 Yano et al. ..... 399/176
5,321,476 * 6/1994 Gross ..... 399/66
5,450,180 * 9/1995 Ohzeki et al. ..... 399/314 X
5,915,145 * 6/1999 Shimura et al. ..... 399/66
6,026,257 * 2/2000 Takami et al. ..... 399/66

FOREIGN PATENT DOCUMENTS 3-085575 * 4/1991 (JP) .

* cited by examiner

*Primary Examiner*—Sophia S. Chen
(74) *Attorney, Agent, or Firm*—Fitzpatrick, Cella, Harper & Scinto

(57) ABSTRACT

An image forming apparatus includes an image bearing member and a transfer rotary member for transferring a toner image from the image bearing member onto a transfer material. An applying device applies a constant current to the transfer rotary member. A detector detects a voltage generated in the transfer rotary member when the applying device applies the constant current to the transfer rotary member. A controller controls a voltage applied to the transfer rotary member during a transfer operation. The detector detects the voltages during intervals between consecutive transfer materials, and the controller controls the voltage on the basis of the voltages detected during different intervals.

10 Claims, 13 Drawing Sheets

IMAGE FORMING APPARATUS USING TRANSFER ROLLER HAVING LOW RESISTANCE UNEVENNESS IN CIRCUMFERENTIAL DIRECTION

FIELD OF THE INVENTION AND RELATED ART

The present invention relates to an image forming apparatus such as a copying machine or a printer, and more particularly to an image forming apparatus using a transfer roller. Referring first to FIG. 10, an image forming apparatus not using the present invention is shown.

The image forming apparatus is a laser beam printer capable of automatic both sided printing on an A3 sheet, and capable of automatic both sided print on A4 sheet fed in a direction along a short side at speed of 24 sheets per minute (process speed of 100 mm/sec).

Referring to FIG. 10, the image formation strokes in the image forming apparatus will be described. First, a surface of a photosensitive drum 1 located substantially at a center of the apparatus is uniformly charged by a primary charger 29, and is exposed to image light from light source 28 so that electrostatic latent image is formed on the surface of the photosensitive drum 1. The electrostatic latent image is visualized into a toner image by a developing device 30.

In synchronism with the image formation on the photosensitive drum 1, a sheet of sheet 19 is picked out by a pick-up roller 25 from a sheet cassette 36, and is fed to a pair of registration rollers by way of a feeding guide 34, a feeding roller 33 and a feeding guide 32. A pair of registration rollers 31 are rotated in synchronism with the image on the photosensitive drum 1 to feed the sheet 19 along a transfer guide 14 to a transfer nip formed by the photosensitive drum 1 and the transfer roller 4. The multiple toner images formed on the photosensitive drum 1 are transferred onto the paper 19 by the transfer nip.

After the completion of the transfer, the paper 19 is separated from the photosensitive drum 1 by the curvature of the small diameter drum and the electrostatic separation using the discharging needle 8. As shown in FIG. 11, the discharging needle 8 is supported by an insulation member 9, and is supplied with a voltage having a polarity opposite from the polarity of the transfer bias, from the bias voltage source 51. The paper 19 separated from the photosensitive drum 1 is fed along the feeding guide 10 to the fixing device 13 where the unfixed toner image is fixed into a fixed image.

The paper 19 after the fixing, is fed by a flapper 37 to a feeding guide 39, and is once fed toward the feeding guide 41 by a feeding roller 40, and then is fed toward the feeding guide 42 by the opposite rotation of the feeding roller 40. In this process, the sheet 19 is inverted in its facing orientation.

The inverted sheet 19 is subjected to a transfer stroke after passing through the feeding roller 43 and the feeding guide 44. The paper 19 having been subjected to the second transfer and fixing step, is fed upwardly by a flapper 37, and is discharged onto a sheet discharge tray 46 by way of the feeding guide 38 and the sheet discharging roller 45.

In FIG. 10, reference numeral 47 designates an outer casing which covers the entire apparatus, Designated by reference numeral 100 is a fan for discharging the air from the inside fo the apparatus. Designated by reference numeral 12 is a cleaner for cleaning the surface of the photosensitive drum 1 after the image transfer.

A description will be made as to transfer roller 4. Referring to FIG. 11, there is shown a structure of the transfer portion in detail.

In this Figure, the photosensitive drum 1 is rotated at a peripheral speed of 100 mm/sec in the direction R1 and the transfer roller 9 is rotated in the direction R4. The outer diameter of the photosensitive drum 1 is 30 mm, and the outer diameter of the transfer roller 4 is 20 mm.

The transfer roller 4 comprises a core metal 2 having an outer diameter of 8 mm and an elastic layer 3 having a thickness of 6 mm thereon. The elastic layer 3 comprises foam rubber such as EPDM or sponge, in which electronic conductive particles such as carbon or metal oxide is dispersed to provide a resistance of approx. $10^6$–$10^9$ Ωcm, so that elastic layer 3 is electronic conductive.

In order to transfer the toner image from the photosensitive drum 1 onto the sheet 19, the core metal 2 of the transfer roller 4 is supplied with a bias voltage having a polarity opposite from the charge polarity of the toner, from a transfer bias voltage source 50.

The bias (transfer bias) applied to the transfer roller 4 is determined in the following manner.

In a prior process wherein the sheet 19 is not supplied (prerotation), the core metal 2 is supplied with a current ITO required for the image transfer, and the voltage VTO generated with the voltage is read. In the case of the transfer roller 4 having the structure described above, the proper current ITO is 8 μA. The time period in which the voltage is read, is generally an integer multiple of the time required for one full turn of the transfer roller in consideration of the resistance unevenness of the transfer roller 4. When the outer diameter of the transfer roller 4 is 20 mm, the period is 630 mS. The read voltages are integrated and averaged to determine a representative value.

Calculation and discrimination are carried out on the basis of the read voltage VTO, the transfer voltage (transfer bias) is determined, fundamentally in the following manner.

Transfer voltage: Vt=ax VTO+b (a is a constant, and b is a constant voltage).

Depending on the value of the VTO, a or b is changed, but a=1, b=1.1 kV is used here as a most general case. With the transfer voltage thus determined, the current of 8 μA (current ITO) is assured which is enough for the image transfer, during the sheet passage.

However, the transfer roller 4 using electronic conductive material such as bubble generation EPDM for the elastic layer 3, has a large surface area, with the result that amount of deposition of paper fibers and filler onto the surface is large. Such substance is water absorbent, and therefore, when they are deposited on the surface of the transfer roller 4, the resistance of the transfer roller 4 is lowered.

Additionally, chains of the electroconductive particles in the material of the elastic layer 3 may be broken by stress resulting from bending, with the result of an increase of the resistance at the end portion, and therefore, the current shortage and the transfer defect occur.

Furthermore, due to the improper dispersion of the electroconductive particles and hysteresis of the pressure during handling, the resistance values may be different locally, with the result that a transfer defect occurs at the high resistance portions.

In order to avoid this defect, transfer voltage is set at a relatively high level, but this would result in a transferring electric field which is higher than necessary level at the transfer nip, so that toner scatters widely beyond the image (scattering).

As a counter measurement, a transfer roller using, for the elastic layer, an electroconductive polymer which has low unevenness of the resistance value against pressure, has recently been developed.

In the case of the transfer roller utilizing the electroconductivity of the polymer, the durability is good, but the resistance value is largely dependent on the temperature because of the property of the electroconductivity given to it. FIG. 12 shows a temperature dependence of the resistance value of a transfer roller. A transfer roller using bubble generation EPDM having electronic conductivity exhibits a small influence against the resistance value from the temperature, whereas a transfer roller using NBR material or urethane material having polymer electronic conductivity exhibits a large variation of the resistance value thereof against temperature.

According to FIG. 12, when the temperature rises 1° C., the resistance value of the urethane material transfer roller rises up to approx. 0.95 time, and that of the NBR transfer roller rises approx. 0.93 time.

FIG. 13 shows a temperature change of a transfer roller (NBR) when it is incorporated in the image forming apparatus of FIG. 12, and automatic continuous printing operations are carried out on both sides of letter size sheets having a base weight of 75 g/m$^2$ under the temperature of 16° C. As will be understood from this Figure, the temperature of the transfer roller increases by 18° C. through 500 sheets printing operations. As a result, the resistance value of the transfer roller becomes as small as 0.27 time relative to that at the beginning of the print operation.

In the case of continuous print operations, the transfer bias is detected only in the prerotation period. Therefore, when the continuous print operations are carried out, the transfer voltage is constant despite the fact that resistance value of the transfer roller significantly lowers, with the result that current becomes excessive, and the potential of the nonimage portion of the photosensitive drum is so influenced that a fogged image (trace of sheet) occurs. The transfer voltage is selected in consideration of the tolerance for manufacturing, and therefore, such phenomenon appears at 200 sheets print or later where the resistance value is approx. 0.4 times. The description has been made as to the case of both sides print, but the same problem arises in a one sided print if the temperature in the apparatus rises.

FIG. 14 shows a relation of the transfer voltage and the transferring current (with or without sheet) vs. number of prints in the case of a conventional transfer bias control.

In the case of both sided continuous print, the proper transferring current at the beginning is 8 $\mu$A. The transferring current without sheet (the current when the transfer roller is applied with the transfer voltage without the sheet) is 10 $\mu$A which is smaller than 20 $\mu$A which is the current resulting in image defect, and therefore, even when small size sheets are processed, the back side contamination of the sheet (due of the transfer roller contamination stemming from fog) does not occurs, and even when small size sheets and large size sheets are fed continuously, no problem of fog in the sheet-absent area (small size sheet) does not arise. However, when the number of prints exceeds 200, the resistance value of the transfer roller lowers with the result of increased transferring current, and the transferring current without sheet is larger than 20 $\mu$A which is a limit of image defect.

Such a transfer voltage is not applied during the nonsheet-passing period, but the potential in the nonsheet-passing area of the photosensitive drum during the transfer operation is improper (the absolute value of the negative potential of the photosensitive drum lowers due to the positive bias of the transfer roller at the portion where the transfer roller and the photosensitive drum are contacted to each other in the nonsheet-passing area). When different size sheets are continuously fed, the image defect may occur on a large sheet processed immediately after a small sheet. When the same size sheets are fed continuously, the fog toner may be deposited on the transfer roller, and then may be deposited on the back side of the next sheet, or the trace of the nonsheet-passing area of the photosensitive drum remains as memory with the result of density non-uniformity in a halftone image. In order to stabilize the transfer voltage during the continuous print, it would be considered to detect the voltage of the transfer roller in the interval between the adjacent sheets in the continuous printing.

However, the recently reduction of the time required for the print decreases the sheet interval down to smaller than one full turn of the transfer roller.

If the transfer voltage of the transfer roller is determined in such a short period, the time in which the current is supplied to the transfer roller is smaller than the time required for one full-turn of the transfer roller.

If an unevenness of the resistance of the transfer roller in the circumferential direction is large, the voltage is uneven even under the same ambient condition.

SUMMARY OF THE INVENTION

Accordingly, it is a principal object of the present invention to provide an image forming apparatus using a transfer roller having a small resistance unevenness in a circumferential direction.

It is another object of the present invention to provide an image forming apparatus wherein the time in which the transfer roller is applied with a constant voltage to determine a transfer voltage, is shorter than the time required for one full-turn of the transfer roller.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Hereinafter, the preferred embodiments of the present invention will be described with reference to the drawings.

Since the structures of the image forming apparatuses, exclusive of the transfer portions, which will be referred to in the following description of the embodiments of the present invention are identical, repeating the same description will be avoided.

Embodiment 1

Figure 1:
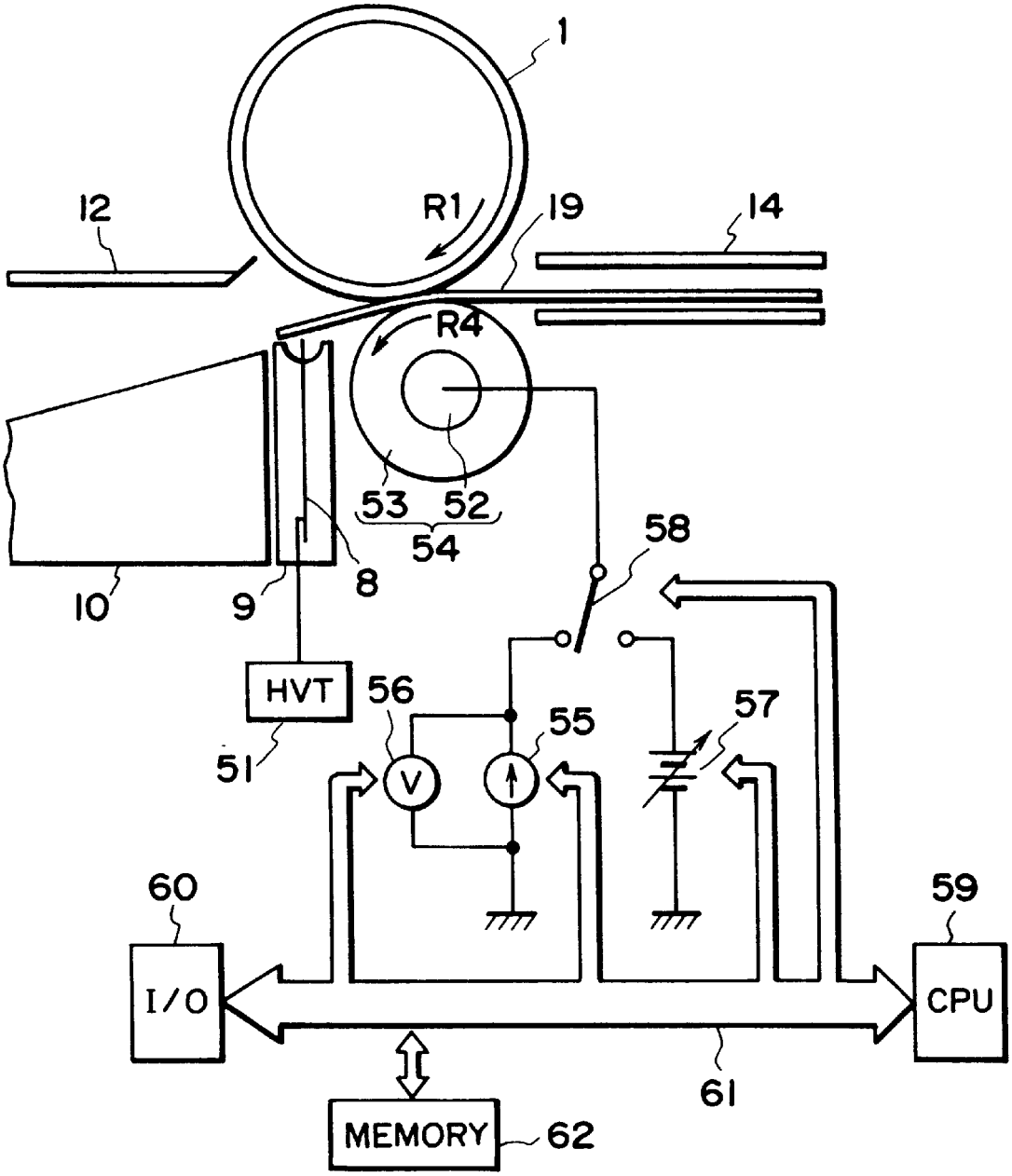
FIG. 1 is a schematic drawing of an embodiment of the present invention in the form of the image transfer portion of an image forming apparatus, and depicts the general structure of the transfer portion.

FIG. 1 is a schematic drawing of an embodiment of the present invention in the form of the transfer portion of an image forming apparatus, and depicts the general structure of the transfer portion.

As illustrated in FIG. 1, a transfer roller 54 comprises a metallic core 52 formed of ordinary steel or stainless steel, and an electrically conductive elastic layer 53 which covers the peripheral surface of the metallic core 52.

According to the present invention, in order to reduce the unevenness of the electrical resistance of the transfer roller 54 in terms of the rotational direction of the transfer roller 54, the elastic layer 53 is formed of polar rubber such as NBR, hydrin rubber, chloroprene rubber, urethane rubber, and the like. Theses materials may be employed alone, or several different polar rubbers may be used in the blended form. Also, they may be employed in combination with nonpolar rubber such as EPDM, in the blended form. Further, they may be used alone, or ionic electrolyte may be added. In this embodiment, the elastic layer 53 is formed of mainly NBR.

These are a few methods for manufacturing the transfer roller 54. According to one of the typical methods, the elastic layer 53 is formed on the peripheral surface of the metallic core 52 by wrapping the peripheral surface of the metallic core 52 with unvulcanized rubber. Then, the rubber layer is thermally vulcanized. According to another method, the elastic layer 53 is formed by extruding rubber in a cylindrical form, and then, thermally vulcanizing the rubber cylinder. The, the metallic core 52 is pressed into the longitudinal through hole of the elastic layer 53.

In the case of this embodiment, the external diameter of the transfer roller 54 is 20 mm, and the external diameter of the photosensitive drum 1 is 30 mm. The peripheral velocities of the photosensitive drum 1 and transfer roller 54 are both 100 mm/sec, and the sheet conveyance velocity is also 100 mm/sec.

Figure 2:
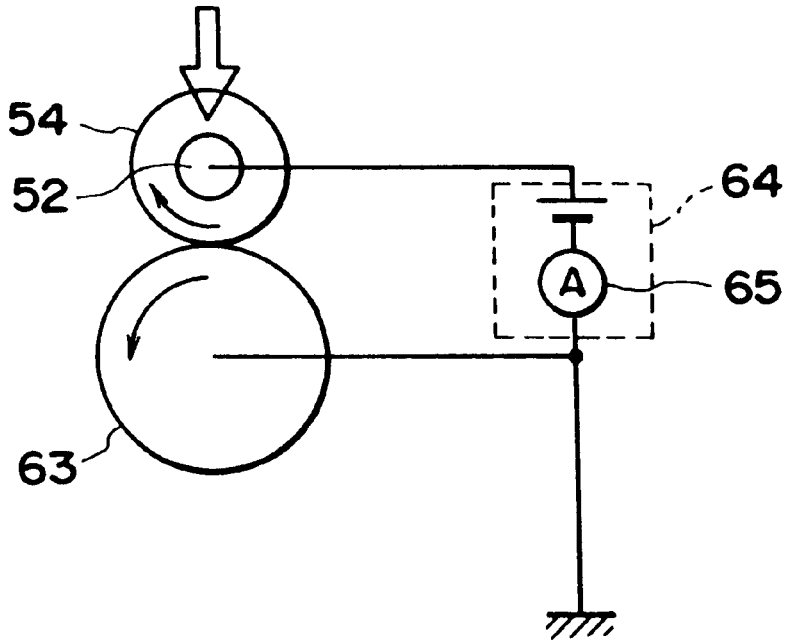
FIG. 2 is a schematic drawing which depicts the method for measuring the electrical resistance of the transfer roller in the transfer portion illustrated in FIG. 1.

A method for measuring the electrical resistance of the transfer roller 54 produced using the above described methods is shown in FIG. 2. As shown in FIG. 2, the peripheral surface of the transfer roller 54 is placed in contact with the peripheral surface of a metallic cylinder 63 by placing a load of 400 gf on each of the longitudinal end portions of the metallic core 52 protruding at the both longitudinal ends of the transfer roller 54, in other words, placing a total load of 800 gf on the transfer roller 54. In this state, the metallic cylinder 63 is rotated so that the transfer roller 54 follows the oration of the metallic cylinder 63. While the metallic cylinder 63 and transfer roller 54 are rotating, a bias of +2 KV is applied between the metallic core 52 of the transfer roller 54 and the metallic cylinder 63, with the use of a power source 64 connected to the metallic core 52 of the transfer roller 54 and the metallic cylinder 63, and the current flowing through the circuit is measured with the use of an ammeter 65 with which the power source 64 is provided. The electrical resistance of the transfer roller 54 is calculated form the relationship between the measured current level and the level of the applied voltage.

Figure 3:
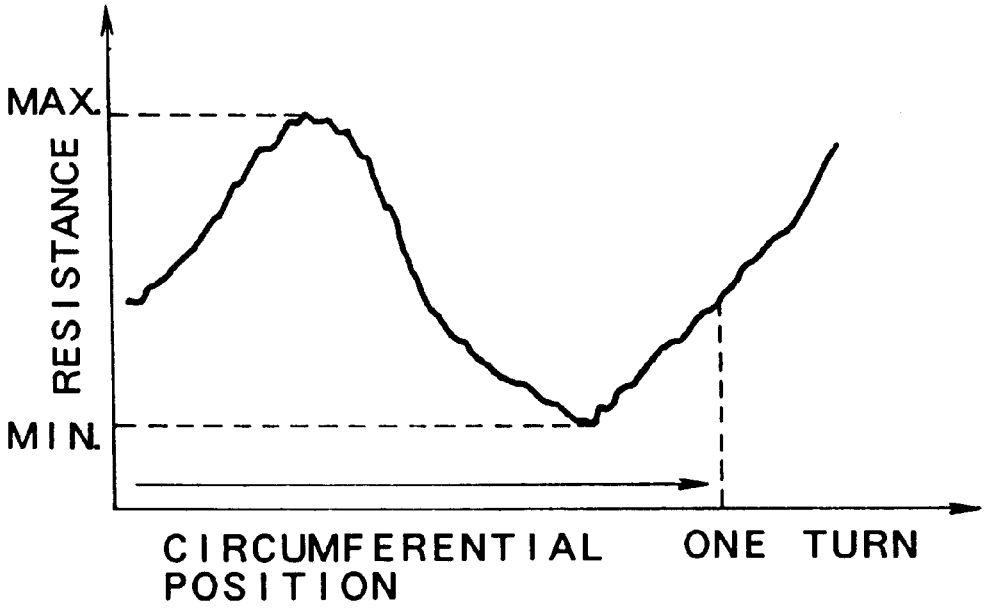
FIG. 3 is a graph which depicts the unevenness of the electrical resistance of the transfer roller in terms of the rotational direction of the transfer roller.

Referring to FIG. 3, the resistance value of the transfer roller 54 generally displays some ripples (variation) in terms of the rotational direction of the transfer roller 54. However, in the case of this embodiment, the elastic layer 53 of the transfer roller 54 is formed of the aforementioned material, and therefore, the resistance value variation in terms of the rotational direction of the transfer roller 54 is relatively small: the ratio of the minimum resistance value to the maximum resistance value is 1.0 to 1.3. The median value (mathematical average value) between the maximum and minimum electrical resistance value is the average resistance value. When the electrical resistance value of a transfer roller is discussed, the median electrical resistance value is referred to as the average electrical resistance value of the roller unless there is a specific provision. The performance of a transfer roller can be improved by reducing the unevenness of the electrical resistance of the transfer roller in terms of the rotational direction of the transfer roller while keeping the average electrical resistance value of the transfer roller within a range of $8\times10^7$–$4\times10^8$ ohm (23° C., 60%RH).

When the electrical resistance value of a transfer roller is no less than $4\times10^8$ ohm in an environment in which temperature and humidity are no more than 15° C. and 15%, respectively, the level of the voltage to be applied to the transfer roller needs to be no less than 6 kV. Thus, creepage distance and air clearance must be increased, which creates structural problems. However, if application of larger voltage can be afforded, it is possible to raise the upper limit of the electrical resistance value of the transfer roller above $6\times10^8$ ohm, in an environment in which temperature and humidity are 23° C. and 60%, respectively.

When the electrical resistance value of a transfer roller is no more than $8\times10^7$ ohm, images suffer from defects such as background fog or the like. More specifically, if a voltage large enough for image transfer is applied to a transfer roller with an electrical resistance value of no more than $8\times10^7$ ohm, that is, an excessively small electrical resistance value, an excessive amount of current flows between the transfer roller and a photosensitive drum, through the range outside the sheet path, affecting the potential level at the peripheral surface of the photosensitive drum. As a result, the aforementioned image defects or the like occurs. This is because the independence at the interface between the transfer roller and the photosensitive drum is smaller in the range outside the sheet path than in the sheet path.

Next, an electrical power system for applying transfer bias to the transfer roller 54, and a system for controlling the power system, will be described. Referring to FIG 1, the transfer power source system comprises a constant currant power source 55 and a constant voltage power source 57. The output level of the constant voltage power source 57 can be varied. These power sources are connected to the metallic core 52 of the transfer roller 54 through a selector switch 58. The constant current power source 55 is connected to a voltmeter 56 for monitoring the voltage while constant current bias is applied.

A CPU 59, an I/O port 60, and a memory 62 are connected through a bus line 61, constituting a control system for controlling the constant current power source 55, voltmeter 56, constant voltage power source 57, and selector switch 58. The CPU controls the operation of the image forming apparatus.

Figure 4:
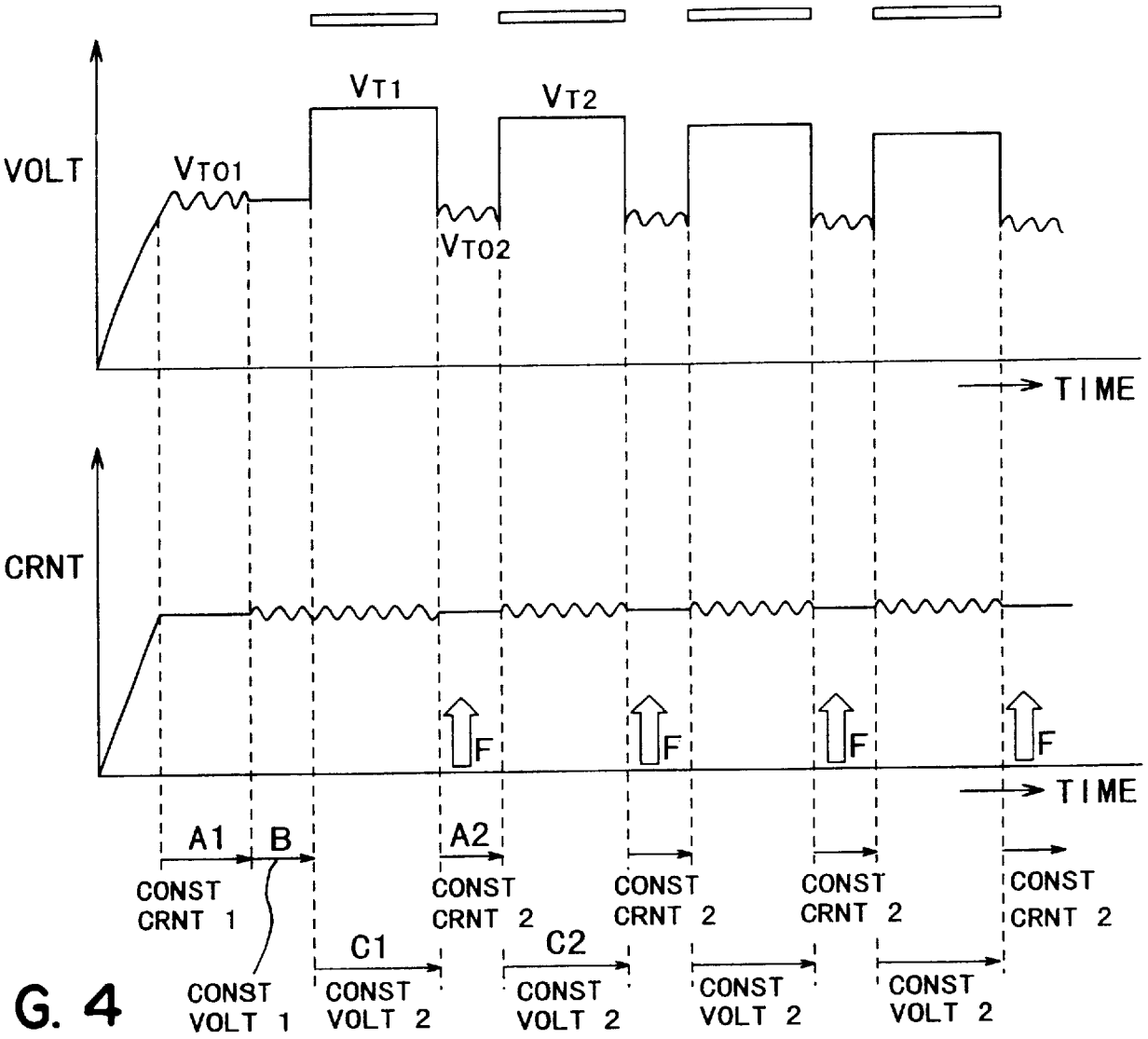
FIG. 4 is a timing chart which shows the sequence for controlling the transfer bias in the transfer portion illustrated in FIG. 1.

Next, a sequence in which bias (transfer bias) is applied to the transfer roller 54 will be described. FIG. 4 is a timing chart for a sequence for controlling the transfer bias in this embodiment.

In this transfer bias control sequence, first, voltage is monitored with the use of the voltmeter 56 during the prerotation period, that is, the period prior to the feeding of the first sheet, while applying a constant current bias of 8 $\mu$A to the transfer roller 54 from the constant current power source 55 (period A1 in FIG. 4). The average level of the monitored voltage in this period is represented by a referential character VT01. Until the unillustrated charging device, developing device, and the like in the image forming apparatus become ready for image formation, the image forming apparatus is kept on standby while applying the voltage VT01 to the transfer roller 54 and rotatively driving the processing devices such as the photosensitive drum, transfer roller, charging roller, and developing roller (period B).

As soon as the preparatory operation is completed, a sheet of recording medium is fed to the transfer nip, and at the same time, the power source is switched from the constant current power source 55 to the constant voltage source power source 57, in other words, the bias being applied to the transfer roller 54 is switched to the printing bias, that is, constant voltage bias, with the use of the switch 58 (period C1). A voltage VT1 of the transfer bias applied to the transfer roller 54 in the period C1 is calculated using the following Formulas:

$$VT1=VT01\times a+b \ (a=1.0\ kV,\ b=1.1\ kV).$$

With the above arrangement, not only can a proper transfer bias be applied, but also the current can be kept constant while a sheet of recording medium is passed as well as while a sheet of recording medium is not passed. In other words, the electrical charge given to the photosensitive drum remains constant. Therefore, desirable image quality can be maintained even while forming a halftone image which is liable to suffer from nonuniform density traceable to the fluctuation of drum potential level. The values of the constants a and b are changed according to apparatus structure or the like.

During the period between the completion of the image transfer onto the first sheet and the beginning of the image transfer onto the second sheet, a constant current bias is applied (period A2). The physical distance between the first and second sheet is shorter than the circumference of the transfer roller. The constant current bias cannot be applied for a length of time equivalent to the circumference of the transfer roller, but since the uneveness of the selectrical resistance of the transfer roller 54 in accordance with the present invention in terms of the rotational direction of the transfer roller 54 is reduced so that the maximum value of the electrical resistance of the transfer roller 54 becomes no more than 1.3 times the minimum electrical resistance of the transfer roller 54, in terms of the rotational direction of the transfer roller 54, there is no problem even when the average voltage level (VT02) obtained by monitoring the voltage for only a short time is used as the central value.

The level of the transfer voltage VT2 to be applied to the transfer roller while the second sheet is passed is calculated based on the level of the voltage VT02 obtained during this sheet interval period. The formula to be used is the same as the one used to calculate the level of the transfer voltage for the first sheet. Unless there are changes in the sheet temperature and ambient temperature, the value of VT02 will be the same as the value of the transfer voltage VT01 for the first sheet, because without the changes in the sheet temperature and ambient temperature, the transfer roller temperature does not change, and therefore, the electrical resistance of the transfer roller does not change either.

However, if the transfer roller temperature increases due to sheet passage and/or the temperature increase in the image forming apparatus, the voltage VT02 becomes smaller than the voltage VT01. On the contrary, if the transfer roller temperature decreases, the voltage VT02 becomes greater than the voltage VT01.

Here, the case in which the voltage VT02 decreases due to the increase in the transfer roller temperature will be described. As the voltage VT02 becomes smaller, the value of the transfer voltage VT2 to be applied to the transfer roller for the second sheet (period C2) also becomes smaller. The levels of the transfer voltages for the third sheet and thereafter will be determined through the same process as the one described above.

As is evident from the above description, in the case of this embodiment of the present invention, the unevenness of the electrical resistance of the transfer roller 54 in terms of its rotational direction is reduced by forming the elastic layer of the transfer roller 54 with the use of polar rubber in which ionic electrolyte is mixed, and the transfer bias is applied using this transfer roller 54 following the above described sequence. Therefore, even if the electrical resistance of the transfer roller decreases due to the increase in the transfer roller temperature as when a plurality of sheets are continuously passed through the transfer station to obtain a plurality of double-sided prints, it is possible to prevent the transfer current from increasing. Therefore, it is possible to prevent the aforementioned type of image defects, for example, a ghost in the form of the edge pattern of a preceding sheet, or the background fog with an appearance of sandy ground, which are liable to occur when a large number of double-sided prints are produced.

Figure 5:
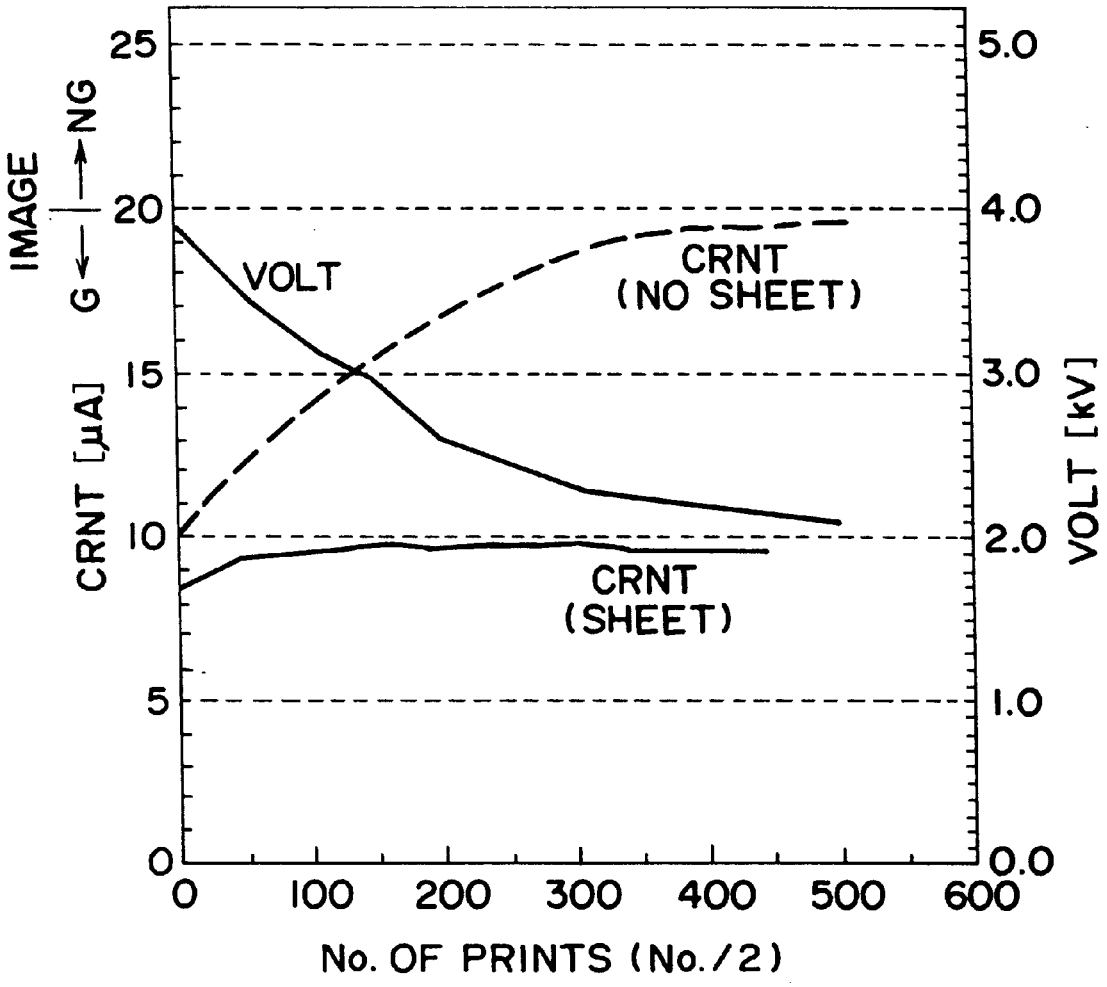
FIG. 5 is a graph which shows the relationship among the number of produced prints, the transfer voltage, and the transfer current, in the transfer portion illustrated in FIG. 1.

FIG. 5 is a graph which shows the relationship among the number of prints produced, transfer voltage, and transfer current, while a sheet of recording medium is passed and while it is not passed, according to this embodiment. As shown in FIG. 5, in the case of the structure in this embodiment, even if the temperature of the transfer roller increases as a large number of double-side prints are continuously made, the transfer voltage is automatically reduced in response to the temperature increase of the transfer roller to keep constant the current which flows while a sheet is passed. Therefore, the same desirable image quality is maintained across all the prints.

The level of the current which flows when the same voltage as the voltage applied to the transfer roller to transfer an image is applied to the transfer roller while no sheet is passed can be suppressed to a voltage no more than 20 $\mu$A, above which a foggy image will be produced. Therefore, it is possible to prevent image defects which might occur when two or more sheets of recording medium different in size are successively fed, for example, a defect in which an image formed on a larger sheet appears foggy across the area correspondent to the sheet path of a smaller sheet, the foggy appearance of the image formed on a larger sheet across the area correspondent to the sheet path of a smaller sheet, the soiling of the back side of a sheet by the contamination of the transfer roller across the area correspondent to the range in which no sheet is passed, and the ghost traceable to the memory in the photosensitive drum created during an image transfer process.

Embodiment 2

This embodiment of the present invention is capable of dealing with a phenomenon that the electrical resistance of the transfer roller 54 becomes uneven in terms of its rotational direction due to the nonuniform temperature increase of the transfer roller in terms of its rotational direction.

This embodiment is capable of effectively dealing with the phenomenon that the temperature of a transfer roller becomes uneven in terms of the sheet conveyance direction. This phenomenon is liable to occur in a high speed image forming apparatus in which the fixing temperature is relatively high, an image forming apparatus equipped with a fixing roller with no more than a 1.5 mm thick elastic layer, the temperature of which is liable to be easily affected by the passage of a sheet of recording medium, or an image forming apparatus equipped with a fixing apparatus, which recently is attracting a great deal of attention due to its ability to save energy and start up quickly, and in which heat is applied to a sheet of recording medium by a heater in the form of a plate through a sheet of film.

The structure of the transfer portion in this embodiment is the same as the one in the first embodiment illustrated in FIG. 1, and therefore, the drawing of this embodiment is omitted.

Figure 6:
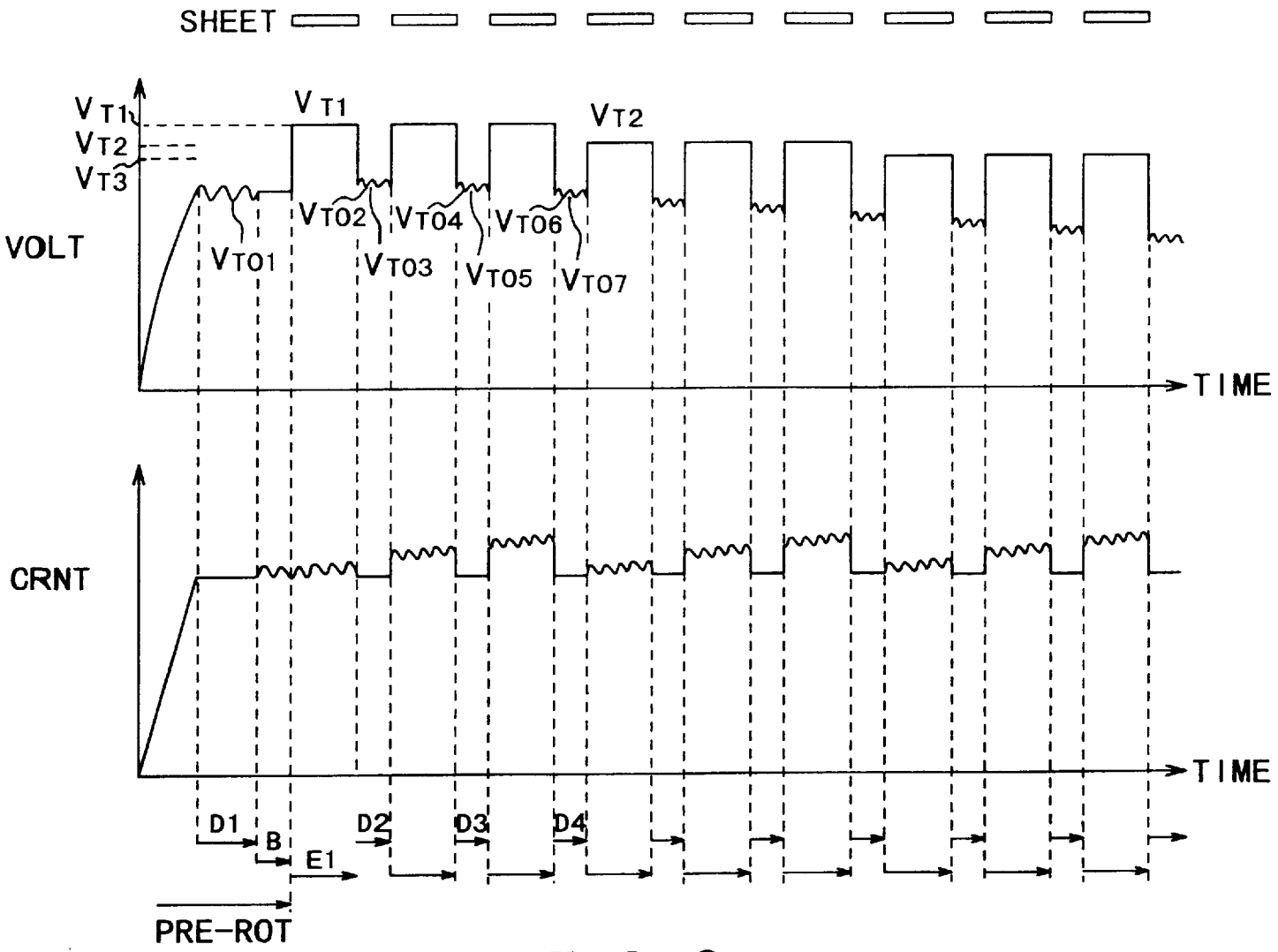
FIG. 6 is a timing chart which depicts the sequence for controlling the transfer bias in another embodiment of the present invention.

FIG. 6 is a timing chart which depicts the transfer bias control sequence according to this embodiment.

During the prerotation prior to the recording medium sheet feeding, the level of the transfer bias for the first sheet is determined. More specifically, first, a constant current bias is applied to a transfer roller for a length of time equivalent to a single rotation of the transfer roller, in a period D1 in FIG. 6, and the voltage required during this period is measured to calculate the value of a voltage VT0 by averaging.

Next, in a period B, the image forming apparatus is kept on standby while maintaining the voltage applied to the transfer roller at the voltage VT01, until the apparatus becomes ready for image formation. During the following printing periods E1, E2 and E3, a transfer bias (VT1) calculated based on the value of the voltage VT01 is applied to the transfer roller.

While the printing operation continues, the transfer roller temperature increases, and the current displays a tendency to gradually increase. During sheet interval periods D2, D3 and D4, a constant current bias is applied to the transfer roller, and during these periods, voltage level is measured.

The voltage level may be continuously measured throughout each sheet interval period. But, here, a case in which the voltage level is measured at two points during each sheet interval period will be described. In other words, in the sheet interval period D2, voltage VT02 and VT03 are measured, and in the sheet interval D3, voltage VT04 and VT05 are measured. In sheet interval period D4, voltages VT06 and VT07 are measured. Then, a referential voltage level for the following printing periods is obtained by averaging all the measured levels of the voltage applied in these periods. A transfer voltage VT2 is obtained through mathematical calculation based on this referential voltage level.

During printing periods in which the fourth to sixth prints are produced, this voltage VT2 is used for transfer, and during the sheet interval periods among these printing periods, the sheet interval voltage levels which come the bases for the referential voltage level for the transfer voltage applied to produce the seventh to ninth prints are measured.

Therefore, the same operation as the one described above is repeated. With this practice, even when the electrical resistance of the transfer roller 54 becomes uneven in terms of its rotational direction, it is possible to always apply a transfer voltage of a proper level to the transfer roller.

In the case of this second embodiment, transfer voltage level is re-evaluated every third print. However, the ordinal number of prints after which transfer voltage level is reevaluated may be adjusted according to the degree of the temperature increase of each transfer roller. It should be noted here that the ordinal number of prints after which transfer voltage level is reevaluated to produce satisfactory images in practical terms may be as high as the 100th. Further, the number of times voltage level is measured during each sheet interval period does not need to be limited to twice; voltage may be measured three or more times.

Embodiment 3

This embodiment of the present invention depicts a structure effective when an image forming apparatus to which the present invention is applied has a plurality of sheet feeding openings, and double-side printing and single-side printing are mixedly carried out.

When double-sided printing and single-side printing are mixedly and continuously carried out, the tendency in the fluctuation of the transfer roller 54 temperature becomes irregular. In other words, sometimes the transfer roller temperature increases, and other times it decreases. This happens, for example, when a large number of single-sided prints are produced immediately after a large number of double-sided prints are produced.

Figure 7:
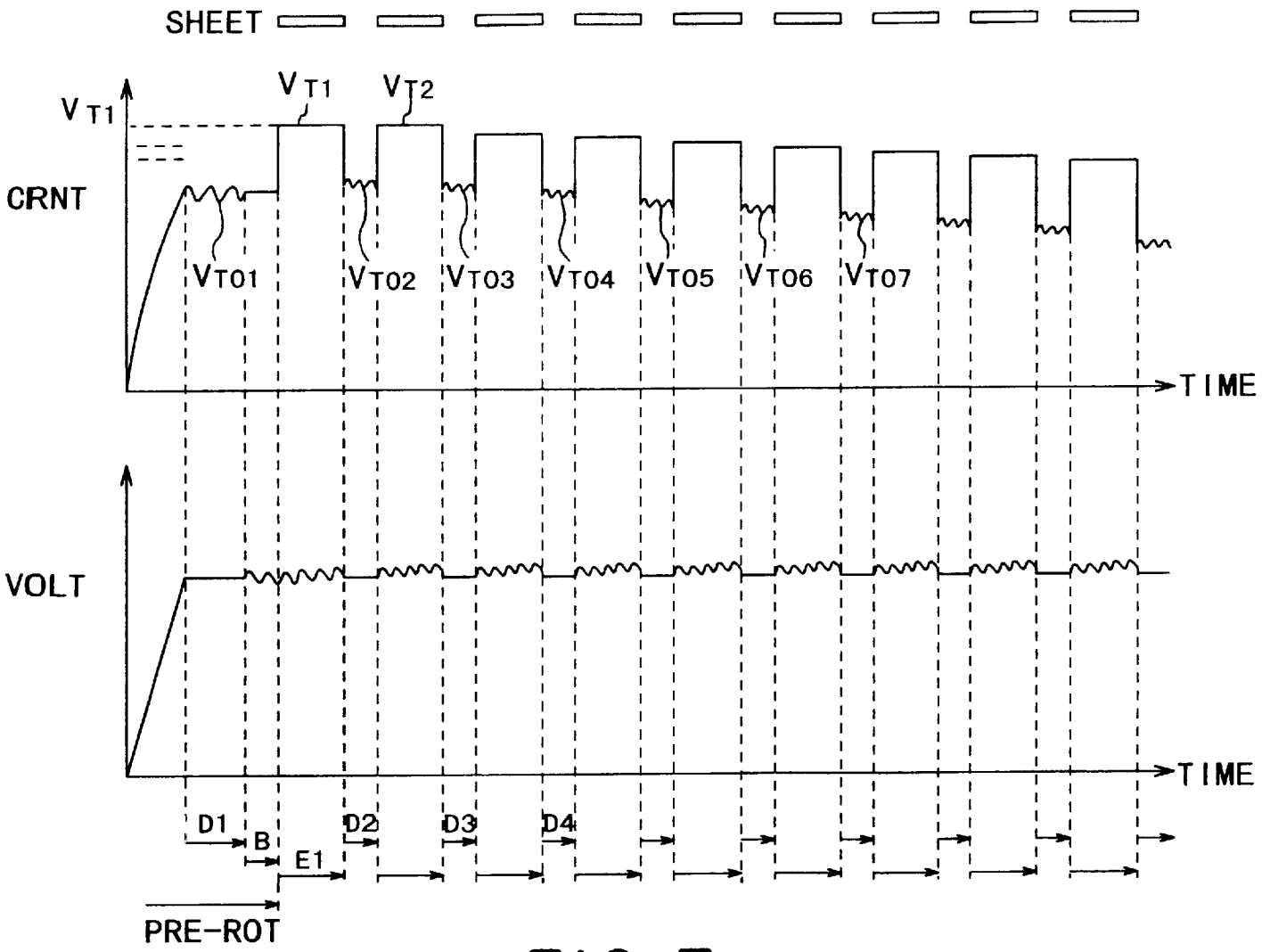
FIG. 7 is a timing chart which depicts the sequence for controlling the transfer bias in another embodiment of the present invention.

In this embodiment, a constant current bias is applied in each sheet interval period, and the level of the voltage to be applied during the immediately following printing period is estimated based on the voltage level measured in each sheet interval period. The timing chart for the voltage control sequence in this embodiment is given in FIG. 7.

During the prerotation period prior to the passage of the first sheet, the transfer bias to be applied during the first printing period is determined. More specifically, first, a constant current bias is applied in a period D1 in FIG. 7 for a length of time equivalent to a single rotation of the transfer roller, and level of a voltage VT01 is determined by averaging the voltage levels measured in the period D1.

Next, during a period B, an image forming apparatus is kept on standby while keeping constant the level of the voltage applied to the transfer roller at the voltage VT01, until the apparatus becomes ready for image formation. During a printing period E1 in which the first print is made, a transfer bias calculated based on the value of the voltage VT01 is applied. During a sheet interval period D2, a constant current bias is applied, and the required voltage is measured. The voltage level measured in the period D2 is designated by a referential character VT02.

The voltage VT01 is the first voltage detected for the purpose of controlling transfer bias, and also constitutes the referential voltage level for the voltage applied in the period in which the first print is produced. A voltage VT02 is the voltage measured in the sheet interval period between the printing periods for the first and second prints. The referential voltage level for the voltage to be applied during the period in which the second print is produced is estimated based on the voltages VT01 and VT02. Here, the estimated referential voltage level for the voltage to be applied during the $n^{th}$ printing period is represented by a referential character VTsn. For example, the level of the transfer voltage to be applied the period in which the second print is produced is represented by a referential character VTs2.

The referential voltage VTsn is estimated using the following Formulas (1) and (2). In Formula (1), only the amount of the voltage fluctuation is taken into consideration.

$$VTsn=VT0n-(VT0n\text{-}1-VT0n) \quad (1)$$

(VT0n represents the voltage level measured in the sheet interval period immediately prior to the printing period in which $n^{th}$ print is produced.)

The proper level of the voltage applied during the printing period is calculated using Formula (2), based on the referential voltage level VTsn estimated using Formula (1).

$$Vin=a\times VTsnb \quad (2)$$

(Vin represents the level of the transfer voltage for the n-th print; a, a constant; and b represents a voltage level.)

When transfer voltage is controlled in the above-described manner, even when the temperature of the transfer roller 54 is liable to fluctuate, it is possible to apply a transfer voltage with a proper level to the transfer roller 54.

A method for estimating the referential voltage level VTsn does not need to be limited to the above-described method. For example, the referential voltage level VTsn may be estimated from the inclination of the voltage fluctuation, calculated based on the voltage levels detected in three or more sheet interval periods. Also, it may be approximated using an exponential function or the like. Further, as for the method for detecting voltage in a sheet interval period, the voltage level may be continuously measured and the VTsn may be estimated by analog integration average, or the voltage level may be detected at two or more points in time during a sheet interval period as in this embodiment.

Figure 8:
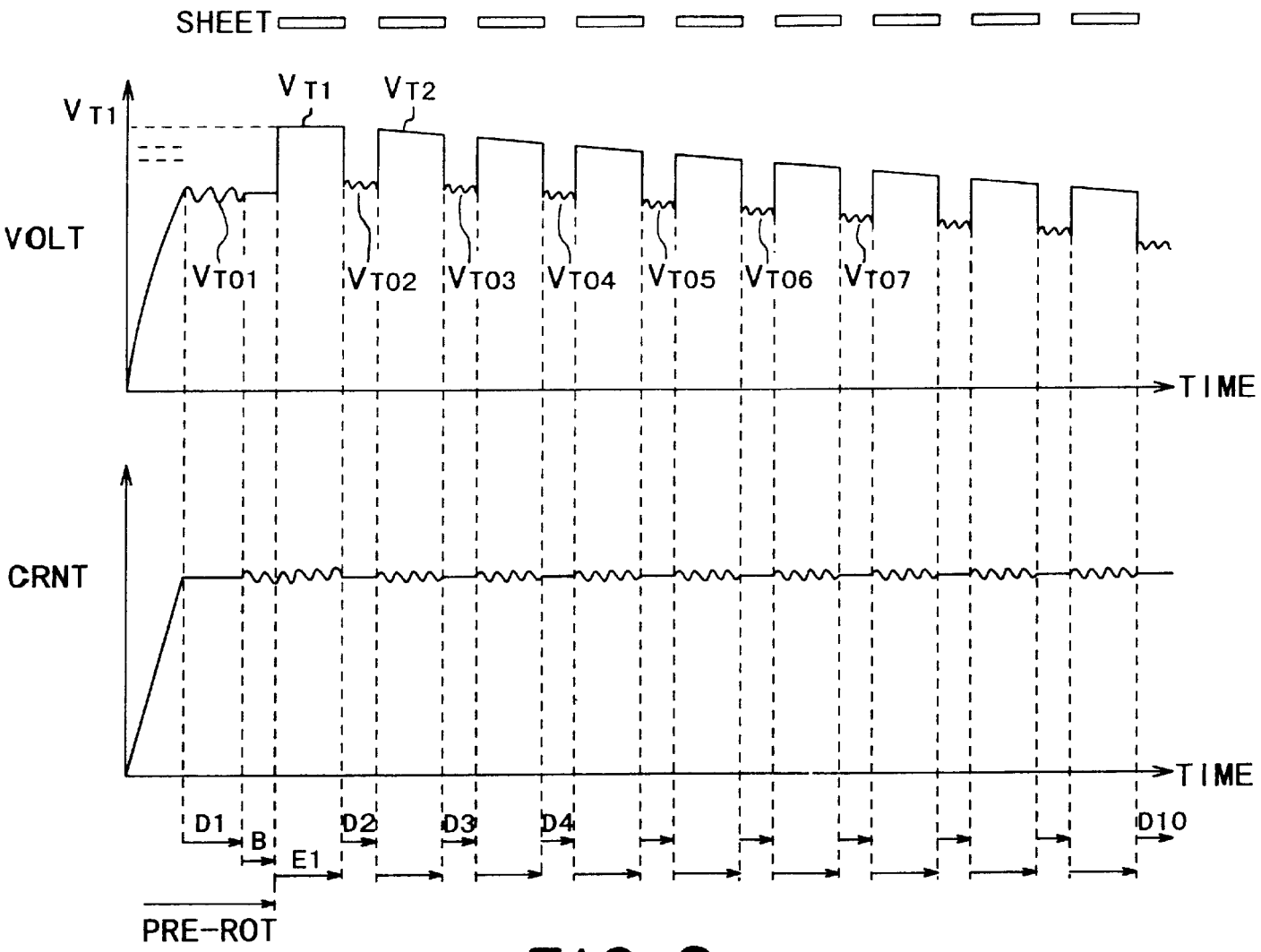
FIG. 8 is a timing chart which depicts the sequence for controlling the transfer bias, which is different form the sequence depicted in FIG. 7.

In the preceding description of this embodiment, the method for applying a transfer voltage of a fixed level to a transfer roller throughout each printing period is demonstrated, but the transfer voltage level may be changed even during each printing period as shown in FIG. 8. When the level of transfer voltage is kept constant during a printing period, the level of transfer current fluctuates during the printing period as shown in FIG. 6. However, if the level of the transfer voltage is adjusted even during a printing period as shown in FIG. 8, the level of transfer current remains constant, producing an effect that image characteristics remain uniform across the entire surface of each sheet.

In the cases of Embodiments 1 through 3, an image transfer process is controlled based on the measured levels of the voltage required to keep constant the current level. However, and image transfer process may be controlled in a manner similar to Embodiments 1 through 3, based on the level of the current measured while sheet interval bias is applied to a transfer roller, as shown in FIG. 9.

Figure 9:
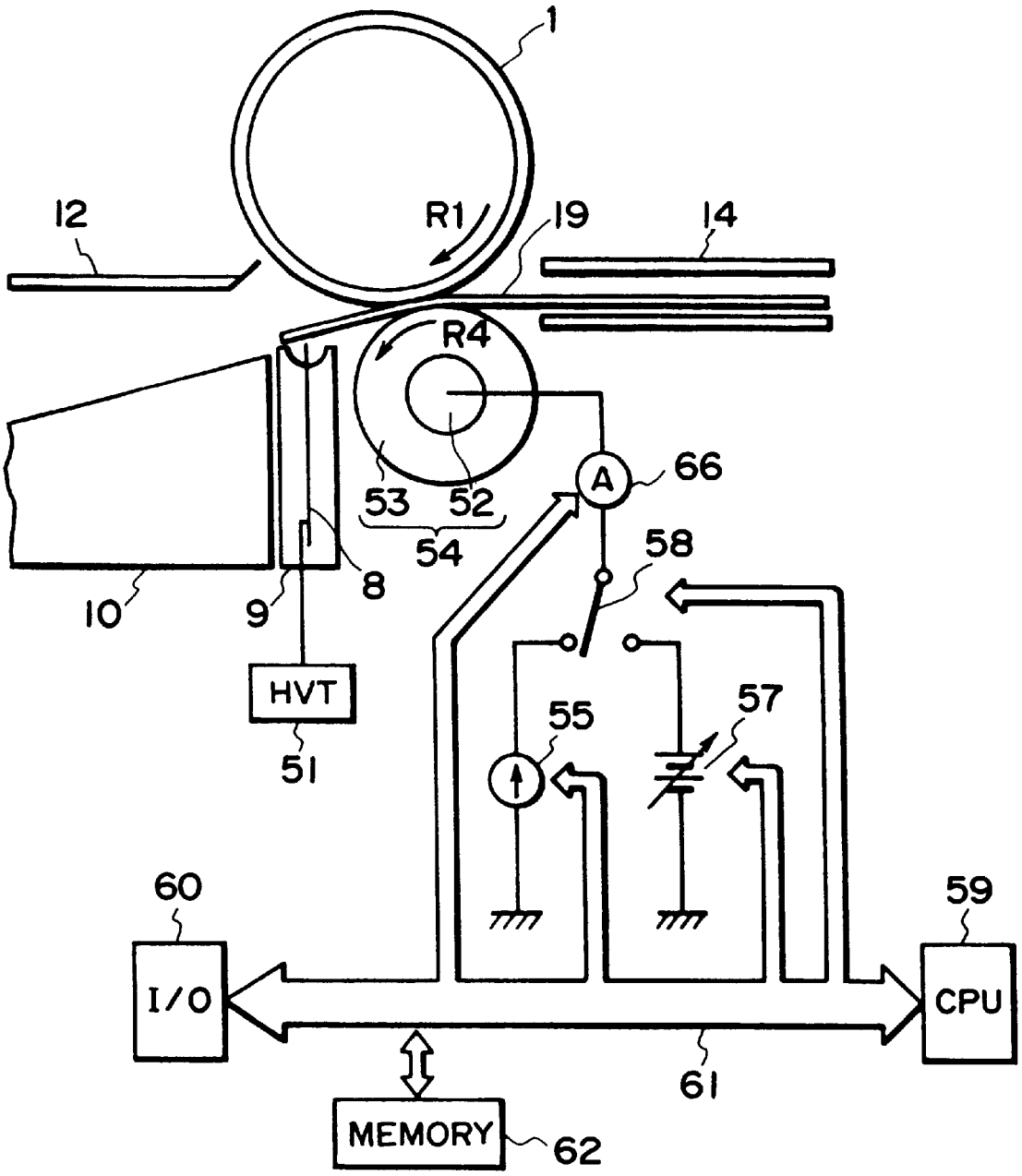
FIG. 9 is a schematic drawing of another embodiment of the present invention in the form of the transfer portion.
Figure 10:
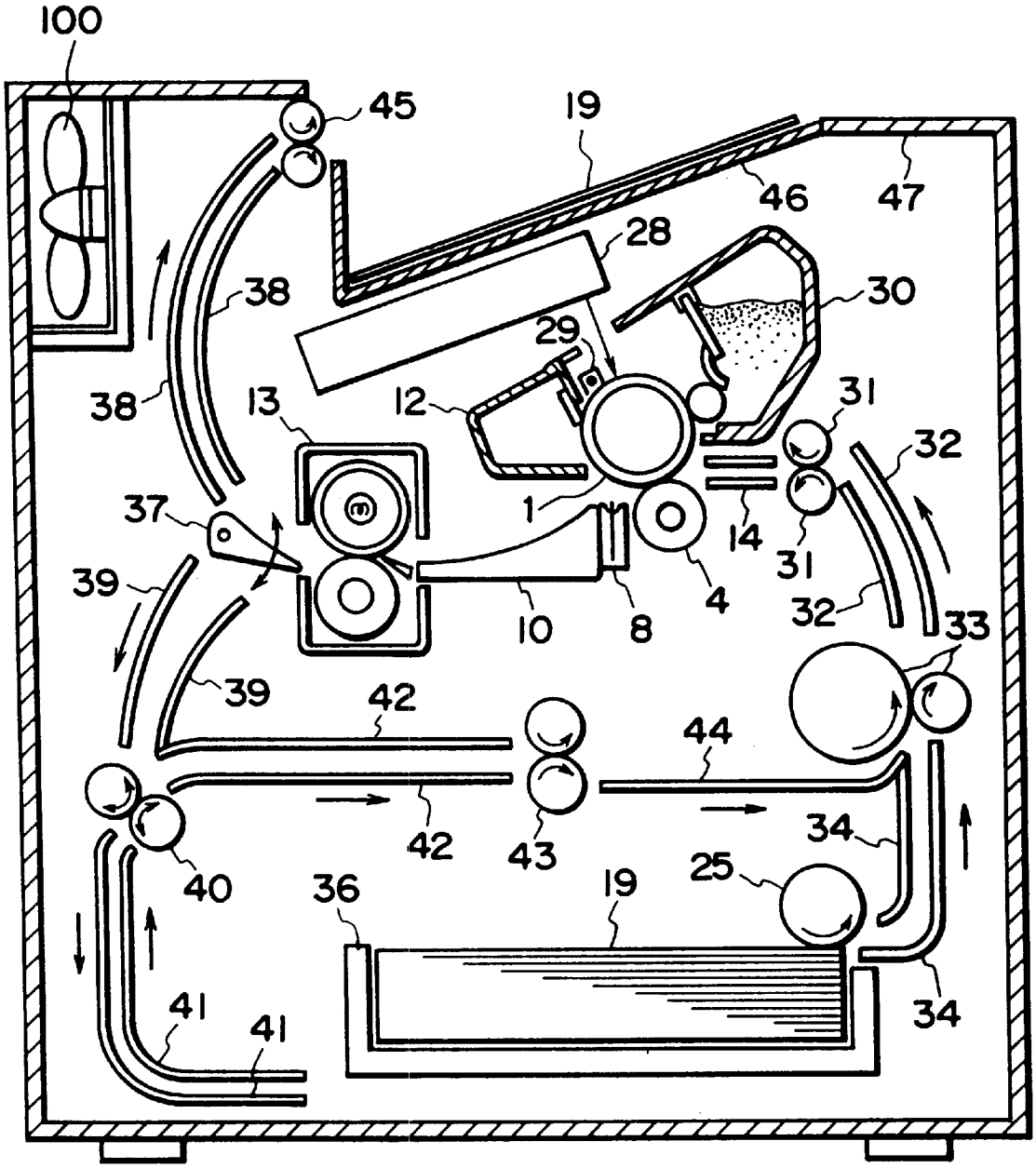
FIG. 10 is a schematic sectional view of an image forming apparatus.
Figure 11:
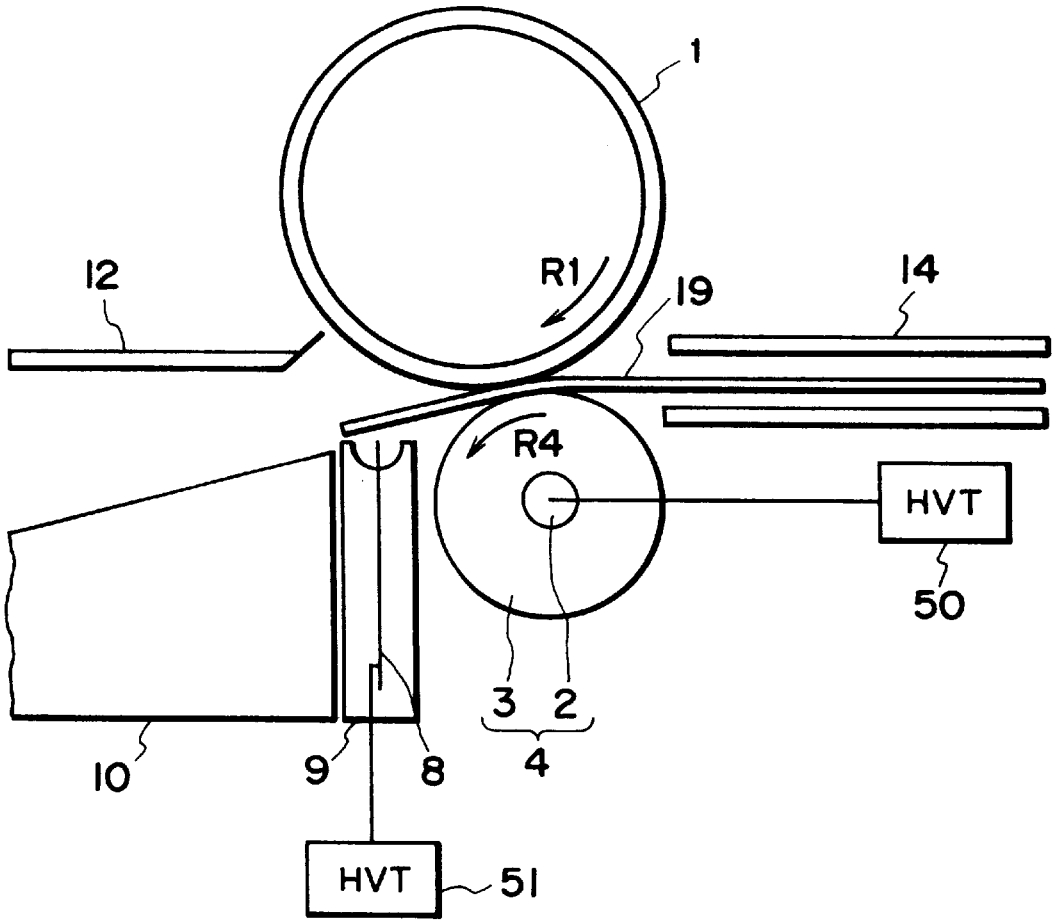
FIG. 11 is a schematic drawing of the transfer portion in the image forming apparatus illustrated in FIG. 10.
Figure 12:
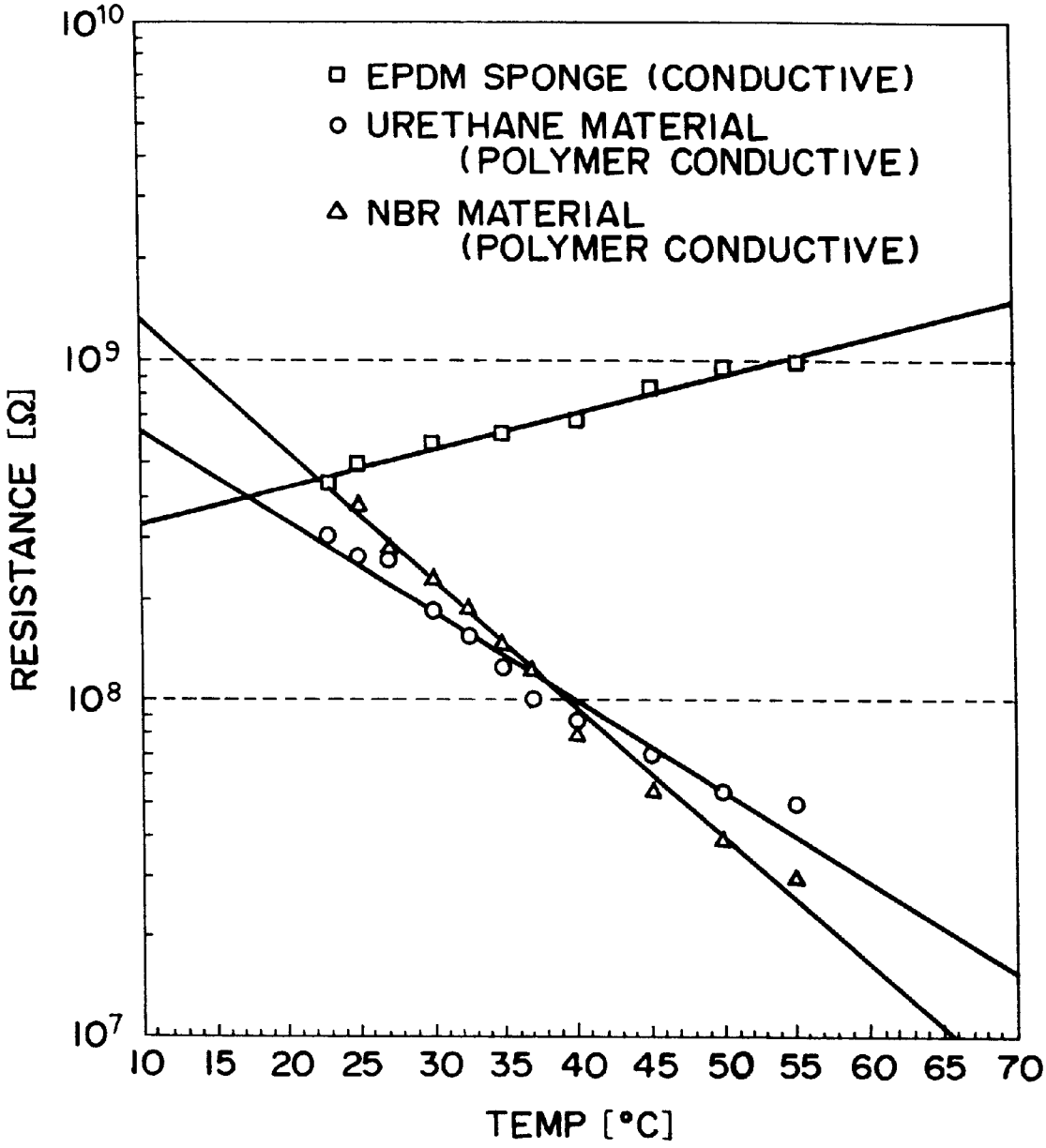
FIG. 12 is a graph which depicts the difference among the various transfer rollers in terms of the relationship between the temperature and electrical resistance of a transfer roller.
Figure 13:
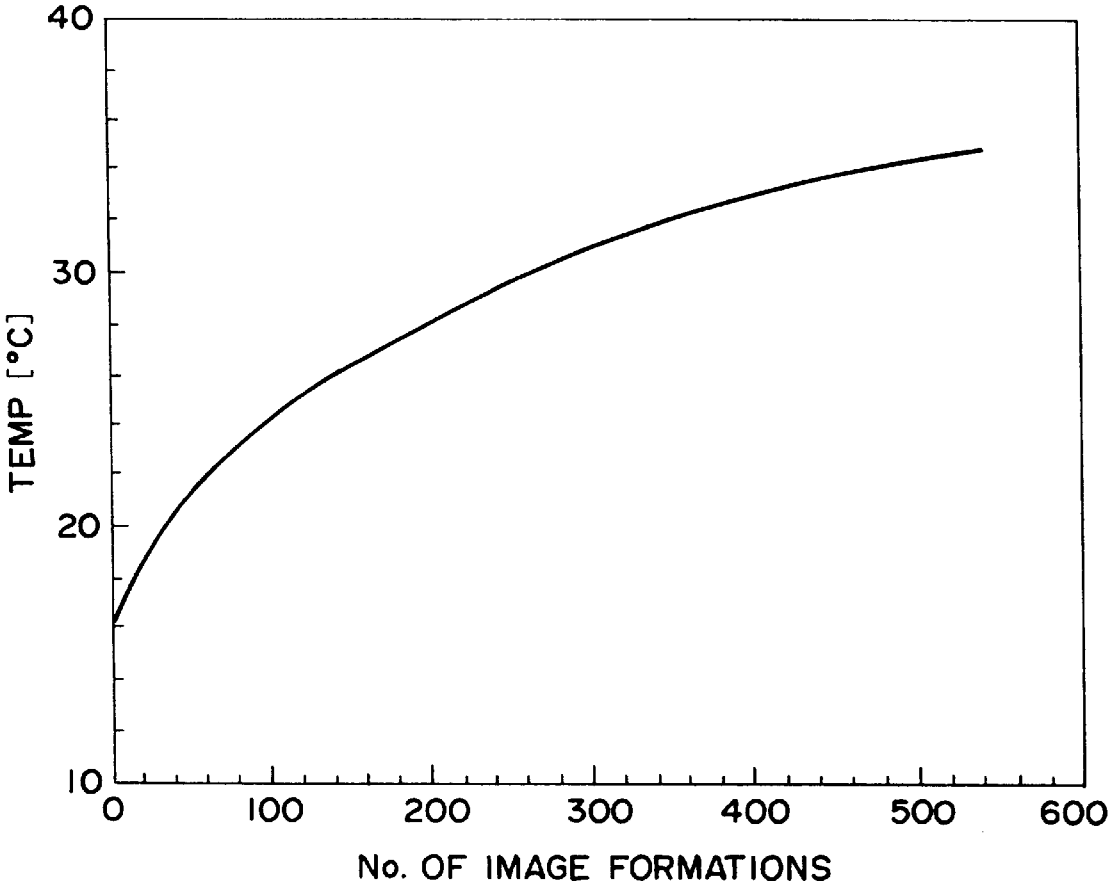
FIG. 13 is a graph which depicts the relationship between the number of prints produced and the transfer roller temperature in the image forming apparatus illustrated in FIG. 10.
Figure 14:
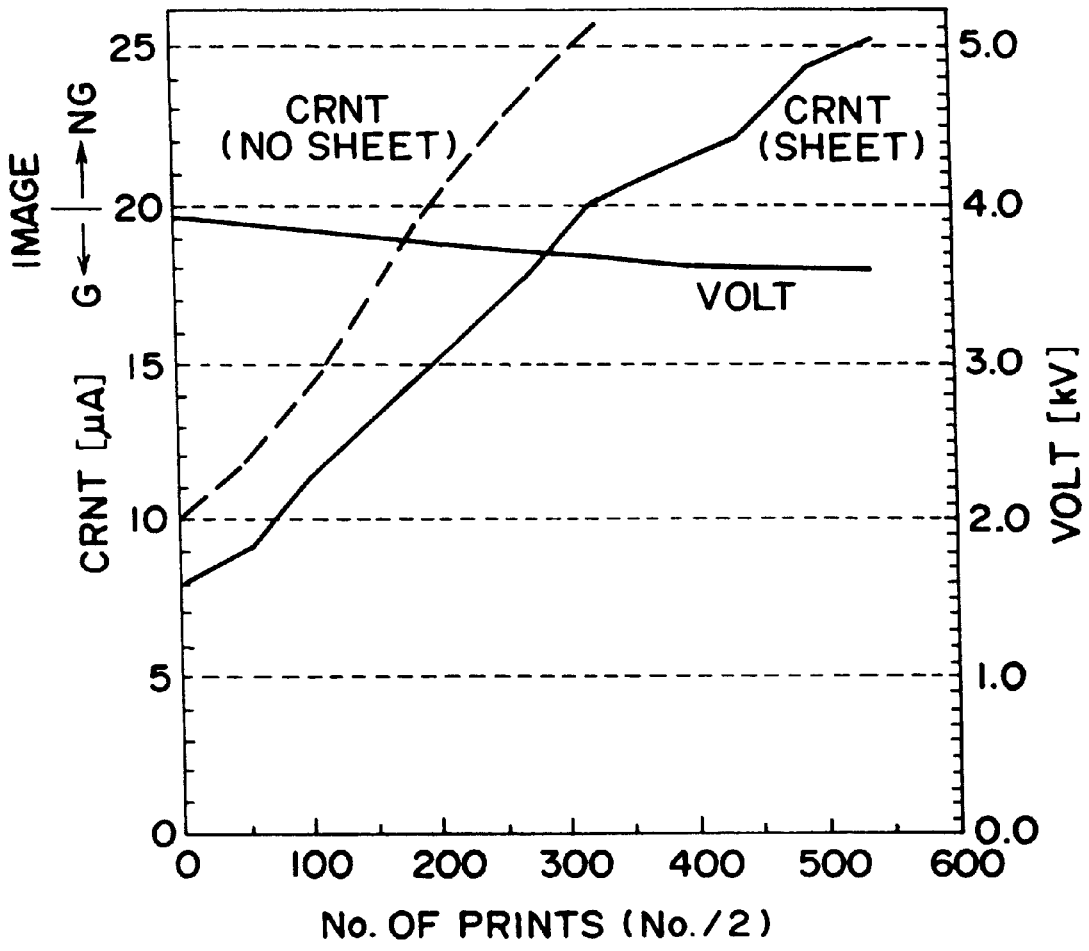
FIG. 14 is a graph which depicts the relation among the number of prints produced, the transfer voltage, and the transfer current, in the image forming apparatus illustrated in FIG. 10.

FIG. 9 illustrates an example of an apparatus for measuring the level of the current while a constant voltage bias is applied. This apparatus is different from the one illustrated in FIG. 1 in that an ammeter 66 is disposed in the line which connects a selector switch 58 for selecting a power source 55 or a power source 57, and the metallic core 52 of a transfer roller 54. The other components in the drawing are the same as those in FIG. 1, and therefore, their description will be omitted.

The current level is measured by the ammeter 66 while a sheet interval bias, that is, the reference voltage level for transfer bias calculation, is applied to a transfer roller by the constant voltage power source 57, the output voltage level of which can be varied. If the change in the measure current level indicates that the current level in a sheet interval period is higher than the current level in the immediately preceding sheet interval period, the level of the transfer voltage to be applied during the immediately following printing period is reduced, and if the change in the measured current level indicates that the current level in a sheet interval period is lower than the current level in the immediately preceding sheet interval, the level of the voltage to be applied during the immediately following printing period is increased. As for the method for controlling the voltage level, the voltage level may be controlled in the same manner as in Embodiments 1 through 3.

A described above, according to the present invention, the elastic layer of a transfer roller is formed of polar polymer, or material which contains ionic electrolyte, reduce the unevenness of the electrical resistance of the transfer roller in terms of its rotational direction. Therefore, the level of the voltage necessary to keep constant the current level of the bias applied to the transfer roller can be detected without an error even if the length of time the voltage level is measured is shorter than the length of time equivalent to a single rotation of the transfer roller. Thus, a proper level for the transfer bias can be easily determined. In addition, the voltage level is detected during a sheet interval period, and therefore, the fluctuation of the transfer current can be suppressed even if the electrical resistance of the transfer roller changes due to the increase in transfer roller temperature. As a result, an image is desirably transferred, producing a print with a high quality image, which does not suffer from background fog or the like defects.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus comprising:

an image bearing member for bearing a toner image;

a transfer rotary member for transferring a toner image from said image bearing member onto a transfer material;

applying means for applying a constant current to said transfer rotary member;

detecting means for detecting a voltage generated in said transfer rotary member when said applying means applies the constant current to said transfer rotary member;

control means for controlling a voltage applied to said transfer rotary member during a transfer operation;

wherein said detecting means detects voltages during intervals between consecutive transfer materials, and said control means controls the applied voltage on the basis of the voltages detected during different intervals.

2. An apparatus according to claim 1, wherein said detecting means detects an average of the voltages during different intervals when the constant current is applied.

3. An apparatus according to claim 1, wherein said control means controls the applied voltage on the basis of the respective detected voltages during the intervals between consecutive transfer materials.

4. An apparatus according to claim 3, wherein said control means controls transfer operations for a plurality of transfer materials on the basis of the detected voltages.

5. An apparatus according to claim 1, wherein said control means applies the applied voltage determined by processing the detected voltages.

6. An apparatus according to claim 1, wherein said transfer rotary member is in the form of a roller, and the duration in which said applying means applies the constant current to said transfer rotary member during the interval is shorter than the time required for said transfer rotary member to rotate one full turn.

7. An apparatus according to claim 6, wherein a ratio between a maximum and minimum of resistances at different circumferential positions is 1.0 to 1.3.

8. An apparatus according to claim 7, wherein said transfer rotary member comprises a roller including a rubber layer made of one of nitrile butadiene rubber, epichlorohydrin rubber, urethane rubber or chloroprene rubber.

9. An apparatus according to claim 7, wherein said transfer rotary member comprises a roller made of an ion-electroconductive rubber.

10. An apparatus according to claim 7, wherein said transfer rotary member has an average resistance of $8\times10^{7}$–$4\times10^{8}$ Ohm.

* * * * *

UNITED STATES PATENT AND TRADEMARK OFFICE

CERTIFICATE OF CORRECTION

PATENT NO. : 6,266,495 B1
DATED : July 24, 2001
INVENTOR(S) : Takayasu Yaminamochi et al.

It is certified that error appears in the above-identified patent and that said Letters Patent is hereby corrected as shown below:

Column 1,
Line 15, "print" should read -- printing --.
Line 48, "once fed" should read -- fed once --.
Line 60, "apparatus," should read -- apparatus. --.
Line 62, "fo" should read -- of --.

Column 3,
Line 41, "sides" should read -- sided --.
Line 56, "does not arise" should read -- arises --.

Column 4,
Line 2, "are contacted" should read -- contact --.
Line 15, "recently" should read -- recent --.

Column 5,
Line 2, "form" should read -- from --.
Line 63, "The," should read -- Then, --.

Column 6,
Line 5, "above described" should read -- above described --.
Line 13, "oration" should read -- rotation --.
Line 22, "form" should read -- from --.

Column 8,
Line 4, "selectrical" should read -- electrical --.
Line 46, "above described" should read -- above-described --.

Column 10,
Line 14, "come" should read -- become --.
Line 37, "double-side" should read -- double-sided --; and "single-side" should read -- single-sided --.
Line 39, "single- side" should read -- single-sided --.

UNITED STATES PATENT AND TRADEMARK OFFICE

CERTIFICATE OF CORRECTION

PATENT NO. : 6,266,495 B1
DATED : July 24, 2001
INVENTOR(S) : Takayasu Yaminamochi et al.

It is certified that error appears in the above-identified patent and that said Letters Patent is hereby corrected as shown below:

Column 12,
Line 15, "measure" should read -- measured --.
Line 30, "reduce" should read -- to reduce --.
Line 62, "member;" should read -- member; and --.
Line 64, "operation;" should read -- operation, --.

Signed and Sealed this

Twenty-sixth Day of March, 2002

*Attest:*

*Attesting Officer*

JAMES E. ROGAN
*Director of the United States Patent and Trademark Office*